US010876183B2

(12) United States Patent
Eguchi et al.

(10) Patent No.: US 10,876,183 B2
(45) Date of Patent: Dec. 29, 2020

(54) HIGH-STRENGTH SEAMLESS STAINLESS STEEL PIPE AND METHOD OF MANUFACTURING HIGH-STRENGTH SEAMLESS STAINLESS STEEL PIPE

(71) Applicant: JFE Steel Corporation, Tokyo (JP)

(72) Inventors: Kenichiro Eguchi, Tokyo (JP); Yasuhide Ishiguro, Tokyo (JP); Takeshi Suzuki, Tokyo (JP); Kazuki Fujimura, Tokyo (JP); Hiroki Ota, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 283 days.

(21) Appl. No.: 15/743,111

(22) PCT Filed: Jun. 13, 2016

(86) PCT No.: PCT/JP2016/002845
§ 371 (c)(1),
(2) Date: Jan. 9, 2018

(87) PCT Pub. No.: WO2017/010036
PCT Pub. Date: Jan. 19, 2017

(65) Prior Publication Data

US 2019/0100821 A1 Apr. 4, 2019

(30) Foreign Application Priority Data

Jul. 10, 2015 (JP) ..... 2015-138635

(51) Int. Cl.

| | |
|---|---|
| ***C21D 9/08*** | (2006.01) |
| ***C22C 38/50*** | (2006.01) |
| ***C22C 38/54*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C21D 1/18*** | (2006.01) |
| ***C21D 1/25*** | (2006.01) |
| ***C22C 38/52*** | (2006.01) |
| *C21D 8/10* | (2006.01) |

(52) U.S. Cl.

CPC ..... *C21D 9/085* (2013.01); *C21D 1/18* (2013.01); *C21D 1/25* (2013.01); *C21D 6/002* (2013.01); *C21D 6/004* (2013.01); *C21D 6/005* (2013.01); *C21D 6/008* (2013.01); *C21D 9/08* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 8/105* (2013.01); *C21D 2211/001* (2013.01); *C21D 2211/004* (2013.01); *C21D 2211/005* (2013.01); *C21D 2211/008* (2013.01)

(58) Field of Classification Search
None
See application file for complete search history.

(56) References Cited

U.S. PATENT DOCUMENTS 10,151,011 B2 * 12/2018 Eguchi ..... C22C 38/54
2006/0243354 A1 11/2006 Kimura et al.
(Continued)

FOREIGN PATENT DOCUMENTS

EP 3023507 A1 5/2016
EP 3260564 A1 12/2017
(Continued)

OTHER PUBLICATIONS

European Communication dated Feb. 7, 2019, of counterpart European Application No. 16824022.4.
(Continued)

*Primary Examiner* — Christopher S Kessler
*Assistant Examiner* — Jiangtian Xu
(74) *Attorney, Agent, or Firm* — DLA Piper LLP (US)

(57) ABSTRACT

A high-strength seamless stainless steel pipe has a composition including, by mass %, 0.05% or less C, 1.0% or less Si, 0.1 to 0.5% Mn, 0.05% or less P, 0.005% or less S, more than 16.0% to 18.0% or less Cr, more than 2.0% to 3.0% or less Mo, 0.5 to 3.5% Cu, 3.0% or more and less than 5.0% Ni, 0.01 to 3.0% W, 0.01 to 0.5% Nb, 0.001 to 0.3% Ti, 0.001 to 0.1% Al, less than 0.07% N, 0.01% or less O, and Fe and unavoidable impurities as a balance, wherein the steel pipe has a microstructure including a tempered martensite phase forming a main phase, 20 to 40% of a ferrite phase in terms of volume ratio, and 25% or less of a residual austenite phase in terms of volume ratio, an average grain size of the ferrite phase is 40 μm or less, and a sum of amounts of Ti and Nb precipitated as precipitates having a grain size of 2 μm or less is 0.06 mass % or more, whereby the steel pipe has high strength where yield strength YS is 758 MPa or more and high toughness where an absorbing energy value $vE_{-10}$ in a Charpy impact test at a test temperature of −10° C. is 40 J or more.

8 Claims, No Drawings

(56) References Cited

U.S. PATENT DOCUMENTS

| | | | |
|---|---|---|---|
| 2011/0226378 | A1 | 9/2011 | Kondo et al. |
| 2012/0031530 | A1 | 2/2012 | Takabe et al. |
| 2015/0047831 | A1 | 2/2015 | Nakatsuka et al. |
| 2015/0101711 | A1 | 4/2015 | Miyata et al. |
| 2015/0152531 | A1 | 6/2015 | Eguchi et al. |
| 2015/0315684 | A1 | 11/2015 | Eguchi et al. |
| 2016/0215359 | A1 | 7/2016 | Eguchi et al. |
| 2019/0100821 | A1 | 4/2019 | Eguchi et al. |
| 2019/0368001 | A1 | 12/2019 | Kamo et al. |
| 2019/0376157 | A1 | 12/2019 | Kamo et al. |
| 2020/0216936 | A1 | 7/2020 | Kamo et al. |

FOREIGN PATENT DOCUMENTS

| | | | |
|---|---|---|---|
| JP | 2005-336595 | A | 12/2005 |
| JP | 2008-81793 | A | 4/2008 |
| JP | 2010-209402 | A | 9/2010 |
| JP | 2010-242163 | A | 10/2010 |
| JP | 2011-252222 | A | 12/2011 |
| JP | 2012-149317 | A | 8/2012 |
| JP | 2015-161010 | A | 9/2015 |
| WO | 2010/050519 | A1 | 5/2010 |
| WO | 2010/134498 | A1 | 11/2010 |
| WO | 2013/146046 | A1 | 10/2013 |
| WO | 2013/179667 | A1 | 12/2013 |
| WO | 2014/097628 | A1 | 6/2014 |
| WO | WO-2014097628 | A1 * | 6/2014 ..... C22C 38/50 |
| WO | 2015/033518 | A1 | 3/2015 |
| WO | 2015/064006 | A1 | 5/2015 |

OTHER PUBLICATIONS

Japanese Office Action dated Jul. 13, 2017, of counterpart Japanese Application No. 2016-553039, along with a Concise Statement of Relevance in English.

Extended European Search Report dated Mar. 19, 2018, of counterpart European Application No. 16824022.4.

Official Action dated Apr. 27, 2020, of related U.S. Appl. No. 16/089,198.

Official Action dated Jul. 8, 2020, of related U.S. Appl. No. 16/089,198.

Official Action dated Oct. 28, 2020, of related U.S. Appl. No. 16/318,978.

Official Action dated Oct. 28, 2020, of related U.S. Appl. No. 16/076,138.

* cited by examiner

HIGH-STRENGTH SEAMLESS STAINLESS STEEL PIPE AND METHOD OF MANUFACTURING HIGH-STRENGTH SEAMLESS STAINLESS STEEL PIPE

TECHNICAL FIELD

This disclosure relates to a high-strength seamless stainless steel pipe and a method of manufacturing a high-strength seamless stainless steel pipe. The disclosure relates to a 17 Cr-based high-strength seamless stainless steel pipe preferably used in oil wells for crude oil, gas wells for a natural gas (hereinafter simply referred to as "Oil Country Tubular Goods") or the like, particularly to a high-strength seamless stainless steel pipe that can particularly improve corrosion resistance in a severe corrosive environment containing carbon dioxide gas ($CO_2$) and/or chloride ion (Cr) at a high temperature, an environment containing hydrogen sulfide ($H_2S$) and the like, and further can prevent generation of surface flaws and improve low-temperature toughness.

BACKGROUND

Recently, from a viewpoint of the exhaustion of energy resources anticipated in the near future, there have been observed vigorous energy source developments with respect to oil fields having a high depth which had not been noticed conventionally, and oil fields, gas fields and the like in severe corrosive environments in a so-called "sour" environment containing sulfide and the like. Such oil fields and gas fields are generally extremely deep, and atmospheres of the fields are also in a severe corrosive environment having a high temperature and containing $CO_2$, $Cl^-$ and $H_2S$. Steel pipes for Oil Country Tubular Goods used in these environments are required to have both high strength and excellent corrosion resistance.

Conventionally, in oil fields and gas fields in an environment containing $CO_2$, $Cl^-$ and the like, as a pipe for Oil Country Tubular Goods used for drilling, a 13Cr martensitic stainless steel pipe has been generally used. However, recently, developments of oil wells in a corrosive environment at a higher temperature (high temperature up to 200° C.) have been advanced. In such an environment, there may be situations where the corrosion resistance of 13Cr martensitic stainless steel is insufficient. Accordingly, there has been a demand for a steel pipe for Oil Country Tubular Goods having excellent corrosion resistance that can be used even in such an environment.

To satisfy such a demand, for example, JP 2005-336595 A discloses a high strength stainless steel pipe for Oil Country Tubular Goods having excellent corrosion resistance. The steel pipe has a composition containing, by mass %, 0.005 to 0.05% C, 0.05 to 0.5% Si, 0.2 to 1.8% Mn, 15.5 to 18% Cr, 1.5 to 5% Ni, 1 to 3.5% Mo, 0.02 to 0.2% V, 0.01 to 0.15% N and 0.006% or less 0, wherein Cr, Ni, Mo, Cu and C satisfy a specific relationship, and further Cr, Mo, Si, C, Mn, Ni, Cu and N satisfy a specific relationship. The steel pipe also has a microstructure including a martensite phase as a base phase, and 10 to 60% of a ferrite phase in terms of volume ratio or, further, 30% or less of an austenite phase in terms of volume ratio. Therefore, JP 2005-336595 A determines that it is possible to stably manufacture a stainless steel pipe for Oil Country Tubular Goods exhibiting sufficient corrosion resistance also in a severe corrosive environment of high temperature of 200° C. or above containing $CO_2$ and $Cl^-$ and having high strength exceeding yield strength of 654 MPa (95 ksi) and also high toughness.

JP 2008-81793 A discloses a high strength stainless steel pipe for Oil Country Tubular Goods having high toughness and excellent corrosion resistance. In the technique described in JP 2008-81793 A, the steel pipe has a composition containing, by mass %, 0.04% or less C, 0.50% or less Si, 0.20 to 1.80% Mn, 15.5 to 17.5% Cr, 2.5 to 5.5% Ni, 0.20% or less V, 1.5 to 3.5% Mo, 0.50 to 3.0% W, 0.05% or less Al, 0.15% or less N and 0.006% or less 0, wherein Cr, Mo, W and C satisfy a specific relationship, Cr, Mo, W, Si, C, Mn, Cu, Ni and N satisfy a specific relationship, and Mo and W satisfy a specific relationship. The steel pipe also has a microstructure including a martensite phase as a base phase, and 10 to 50% of a ferrite phase in terms of volume ratio. Therefore, JP 2008-81793 A determines that is possible to stably manufacture a high-strength stainless steel pipe for Oil Country Tubular Goods having high strength where yield strength exceeds 654 MPa (95 ksi) and exhibiting sufficient corrosion resistance even in severe corrosive environment of high temperature containing $CO_2$, $Cl^-$ and $H_2S$.

WO 2010/050519 discloses a high-strength stainless steel pipe having excellent sulfide stress cracking resistance and excellent high-temperature carbon dioxide gas corrosion resistance. In the technique described in WO 2010/050519, the steel pipe has a composition containing, by mass %, 0.05% or less C, 1% or less Si, more than 16% to 18% or less Cr, more than 2% to 3% or less Mo, 1 to 3.5% Cu, 3% or more and less than 5% Ni and 0.001 to 0.1% Al, wherein Mn and N satisfy a specific relationship in a region where 1% or less Mn, and 0.05% or less N are present. The steel pipe also has a microstructure including a martensite phase as a base phase, and 10 to 40% of ferrite phase in terms of volume ratio and 10% or less of residual austenite (γ) phase in terms of volume ratio. Therefore, WO 2010/050519 determines that it is possible to stably manufacture a high-strength stainless steel pipe having excellent corrosion resistance and high strength exceeding yield strength of 758 MPa (110 ksi), exhibiting sufficient corrosion resistance even in a carbon dioxide gas environment of high temperature of 200° C. and exhibiting sufficient sulfide stress cracking resistance even when an environment gas temperature is lowered.

WO 2010/134498 discloses a stainless steel pipe for Oil Country Tubular Goods. In the technique described in WO 2010/134498, the stainless steel pipe for Oil Country Tubular Goods has a composition containing, by mass %, 0.05% or less C, 0.5% or less Si, 0.01 to 0.5% Mn, more than 16.0% to 18.0% Cr, more than 4.0% to 5.6% Ni, 1.6 to 4.0% Mo, 1.5 to 3.0% Cu, 0.001 to 0.10% Al and 0.050% or less N, wherein Cr, Cu, Ni and Mo satisfy a specific relationship and, further, (C+N), Mn, Ni, Cu and (Cr+Mo) satisfy a specific relationship. The steel pipe also has a microstructure including a martensite phase and 10 to 40% of ferrite phase in terms of volume ratio, and in which a ratio that a plurality of imaginary segments having a length of 50 μm in a thickness direction from a surface and are arranged in a row within a range of 200 μm at pitches of 10 μm intersects the ferrite phase is larger than 85%, thus providing a high-strength stainless steel pipe for Oil Country Tubular Goods having 0.2% yield strength of 758 MPa or more. Therefore, WO 2010/134498 determines that it is possible to provide a stainless steel pipe for Oil Country Tubular Goods having excellent corrosion resistance in a high-temperature environment of 150 to 250° C. and excellent sulfide stress corrosion cracking resistance at a room temperature.

JP 2010-209402 A discloses a high-strength stainless steel pipe for Oil Country Tubular Goods having high toughness and excellent corrosion resistance. In the technique described in JP 2010-209402 A, the steel pipe has a composition containing, by mass %, 0.04% or less C, 0.50% or less Si, 0.20 to 1.80% Mn, 15.5 to 17.5% Cr, 2.5 to 5.5% Ni, 0.20% or less V, 1.5 to 3.5% Mo, 0.50 to 3.0% W, 0.05% or less Al, 0.15% or less N and 0.006% or less 0, wherein Cr, Mo, W and C satisfy a specific relationship, Cr, Mo, W, Si, C, Mn, Cu, Ni and N satisfy a specific relationship, and Mo and W satisfy a specific relationship. The steel pipe also has a microstructure where, with respect to largest crystal grains, a distance between arbitrary two points in the grain is 200 μm or less. JP 2010-209402 A determines that the stainless steel pipe has high strength exceeding yield strength of 654 MPa (95 ksi), excellent toughness, and exhibits sufficient corrosion resistance in a high-temperature corrosive environment of 170° C. or above containing $CO_2$, $Cl^-$ and $H_2S$.

JP 2012-149317 A discloses a high-strength martensitic seamless stainless steel pipe for Oil Country Tubular Goods. In the technique described in JP 2012-149317 A, the seamless steel pipe has a composition containing, by mass %, 0.01% or less C, 0.5% or less Si, 0.1 to 2.0% Mn, more than 15.5% to 17.5% or less Cr, 2.5 to 5.5% Ni, 1.8 to 3.5% Mo, 0.3 to 3.5% Cu, 0.20% or less V, 0.05% or less Al and 0.06% or less N. The steel pipe has a microstructure preferably including 15% or more of ferrite phase or further including 25% or less of residual austenite phase in terms of volume ratio, and a tempered martensite phase as a balance in terms of volume ratio. In JP 2012-149317 A, in addition to the above-mentioned components, the composition may further contain 0.25 to 2.0% W and/or 0.20% or less Nb. Therefore, JP 2012-149317 A determines that it is possible to stably manufacture a high-strength martensitic seamless stainless steel pipe for Oil Country Tubular Goods having high strength where yield strength is 655 MPa or more and 862 MPa or less and a tensile characteristic where yield ratio is 0.90 or more, and having sufficient corrosion resistance (carbon dioxide gas corrosion resistance, sulfide stress corrosion cracking resistance) even in a severe corrosive environment of high temperature of 170° C. or above containing $CO_2$, $Cl^-$ and $H_2S$.

WO 2013/146046 discloses a stainless steel pipe for Oil Country Tubular Goods. In the technique described in WO 2013/146046, the steel pipe has a composition containing, by mass %, 0.05% or less C, 1.0% or less Si, 0.01 to 1.0% Mn, 16 to 18% Cr, 1.8 to 3% Mo, 1.0 to 3.5% Cu, 3.0 to 5.5% Ni, 0.01 to 1.0% Co, 0.001 to 0.1% Al, 0.05% or less 0 and 0.05% or less N, wherein Cr, Ni, Mo and Cu satisfy a specific relationship and Cr, Ni, Mo and Cu/3 satisfy a specific relationship. The steel pipe also has a microstructure preferably including 10% or more and less than 60% of ferrite phase, 10% or less of residual austenite phase in terms of volume ratio, and 40% or more of a martensite phase in terms of volume ratio. Therefore, WO 2013/146046 determines that it is possible to obtain a stainless steel pipe for Oil Country Tubular Goods that can stably exhibit high strength where yield strength is 758 MPa or more and excellent high-temperature corrosion resistance.

Along with the recent development of oil fields, gas fields and the like in a severe corrosive environment, steel pipes for Oil Country Tubular Goods are required to have high strength of yield strength of 758 MPa (110 ksi) or more and to maintain excellent corrosion resistance together with excellent carbon dioxide gas corrosion resistance, excellent sulfide stress corrosion cracking resistance and excellent sulfide stress cracking resistance even in a severe corrosive environment of high temperature of 200° C. or above and containing $CO_2$, $Cl^-$ and $H_2S$.

In the techniques described in JP 2005-336595 A, JP 2008-81793 A, WO 2010/050519, WO 2010/134498, JP 2010-209402 A, JP 2012-149317 A and WO 2013/146046, a large amount of alloy elements using 17% Cr as a base are contained in the steel pipe to enhance corrosion resistance. However, such composition exhibits a two phase region formed of (ferrite+austenite) during hot rolling. Accordingly, in hot rolling, there arises a problem that strain is concentrated in ferrite which is a soft phase so that flaws (rolling flaws) are frequently generated.

To cope with such a drawback, with respect to 17% Cr-based stainless steel, an attempt has been made to reduce rolling flaws by setting a heating temperature of a steel raw material at a high temperature in hot rolling. However, in 17% Cr-based stainless steel, when the steel is heated at a high temperature, the microstructure of the steel becomes a ferrite single phase and, hence, crystal grains are liable to become coarse whereby coarse ferrite grains remain even after hot rolling thus giving rise to a drawback that low-temperature toughness is deteriorated.

It could therefore be helpful to provide a high-strength seamless stainless steel pipe and a method of manufacturing a high-strength seamless stainless steel pipe that can overcome these drawbacks, can be manufactured without frequently generating rolling flaws, and can also acquire high strength, that is, yield strength of 758 MPa or more, and excellent low-temperature toughness together with excellent corrosion resistance.

"Excellent low-temperature toughness" means that an absorbing energy value in a Charpy impact test $vE_{-10}$ at a test temperature of −10° C. is 40 (J) or more.

"Excellent corrosion resistance" is a concept including "excellent carbon dioxide gas corrosion resistance", "excellent sulfide stress corrosion cracking resistance" and "excellent sulfide stress cracking resistance".

"Excellent carbon dioxide gas corrosion resistance" means a state where, when a specimen is immersed in 20% NaCl aqueous solution (solution temperature: 200° C., $CO_2$ gas atmosphere of 30 atmospheric pressure) which is a test solution held in an autoclave for 336 hours, the specimen exhibits a corrosion rate of 0.125 mm/y or below.

"Excellent sulfide stress corrosion cracking resistance" means a state where, when a specimen is immersed into an aqueous solution whose pH is adjusted to 3.3 by adding an acetic acid and sodium acetate into a test solution held in an autoclave (20% NaCl aqueous solution (solution temperature: 100° C., $CO_2$ gas at 30 atmospheric pressure, $H_2S$ atmosphere of 0.1 atmospheric pressure)), an immersion period is set to 720 hours, and 100% of yield stress is applied to the specimen as a load stress, no crack occurs in the specimen after the test.

"Excellent sulfide stress cracking resistance" means a state where, when a specimen is immersed into an aqueous solution whose pH is adjusted to 3.5 by adding an acetic acid and sodium acetate into a test solution held in an autoclave (20% NaCl aqueous solution (solution temperature: 25° C., $CO_2$ gas at 0.9 atmospheric pressure, $H_2S$ atmosphere of 0.1 atmospheric pressure)), an immersion period is set to 720 hours, and 90% of yield stress is applied to the specimen as a load stress, no crack occurs in the specimen after the test.

SUMMARY

We studied various factors that influence refining of ferrite grains in the composition of 17% Cr stainless steel. We discovered the concept of making use of an effect of pinning crystal grains by Nb precipitates (Nb carbonitride)

and Ti precipitates (Ti carbonitride) to prevent ferrite grains (crystal grains) from becoming coarse. Then, we found that by adjusting contents of C, N, Nb and Ti such that average grain sizes A(μm) of Nb precipitates and Ti precipitates (Nb carbonitride and Ti carbonitride) and a sum of amounts B (mass %) of precipitated Nb and Ti at a heating temperature T(° C.) in a heating step performed prior to a hot pipe forming step satisfy formula (1), even when the heating temperature T is increased to reduce rolling flaws, it is possible to prevent ferrite grains from becoming coarse and, at the same time, ferrite grains in a finished product are refined so that low-temperature toughness of the finished product can be brought into a desired range. Thus, when a mother phase grain boundary is pinned to fine precipitate particles, an average grain size of a mother phase is proportional to an average grain size of fine precipitate grains, and is inversely proportional to the power of ⅔ of a volume ratio of fine precipitate grains.

$$A/B^{2/3} \leq 14.0 \quad (1)$$

We thus provide:

[1] A high-strength seamless stainless steel pipe having a composition comprising, by mass %, 0.05% or less C, 1.0% or less Si, 0.1 to 0.5% Mn, 0.05% or less P, 0.005% or less S, more than 16.0% to 18.0% or less Cr, more than 2.0% to 3.0% or less Mo, 0.5 to 3.5% Cu, 3.0% or more and less than 5.0% Ni, 0.01 to 3.0% W, 0.01 to 0.5% Nb, 0.001 to 0.3% Ti, 0.001 to 0.1% Al, less than 0.07% N, 0.01% or less 0, and Fe and unavoidable impurities as a balance, wherein the steel pipe has a microstructure comprising a tempered martensite phase forming a main phase, 20 to 40% of a ferrite phase in terms of volume ratio, and 25% or less of a residual austenite phase in terms of volume ratio, an average grain size of the ferrite phase is 40 μm or less, and a sum of amounts of Ti and Nb which are precipitated as precipitates having a grain size of 2 μm or less is 0.06 mass % or more, whereby the steel pipe has high strength where yield strength YS is 758 MPa or more and high toughness where an absorbing energy value $vE_{-10}$ in a Charpy impact test at a test temperature of −10° C. is 40 J or more.

[2] The high-strength seamless stainless steel pipe described in [1], wherein the steel pipe further has a composition containing, by mass %, one kind or two or more kinds selected from a group consisting of 0.5% or less V, 0.2% or less Zr, 1.4% or less Co, 0.1% or less Ta, and 0.0050% or less B, adding to the above-mentioned composition.

[3] The high-strength seamless stainless steel pipe described in [1] or [2], wherein the steel pipe further has a composition containing, by mass %, one kind or two kinds selected from a group consisting of 0.0005 to 0.0050% Ca and 0.001 to 0.01% REM, adding to the above-mentioned composition.

[4] A method of manufacturing the high-strength seamless stainless steel pipe described in any one of [1] to [3], the method including: a heating step of heating a steel pipe raw material having the composition; a hot pipe forming step of forming a seamless steel pipe by applying hot pipe forming to the steel pipe raw material heated in the heating step; a cooling step of cooling the seamless steel pipe obtained by the hot pipe forming step; and a heat treatment step of applying quenching treatment to the seamless steel pipe cooled by the cooling step at a heating temperature of 850 to 1050° C. and applying tempering treatment to the seamless steel pipe subsequently, wherein in the heating step, the steel pipe raw material is heated at a heating temperature T(° C.) of 1210 to 1350° C. and at which an average grain size A (μm) of precipitates of Ti and Nb and a sum of amounts B (mass %) of precipitated Ti and Nb at the heating temperature T satisfy formula (1)

$$A/B^{2/3} \leq 14.0 \quad (1)$$

wherein, A: average grain size (μm) of precipitates of Ti and Nb at heating temperature T B: sum of amounts (mass %) of precipitated Ti and Nb at heating temperature T.

It is possible to easily as well as stably manufacture a high-strength seamless stainless steel pipe as a steel pipe for Oil Country Tubular Goods having high strength of yield strength YS of 758 MPa or more together with excellent low-temperature toughness and also having excellent corrosion resistance together with excellent carbon dioxide gas corrosion resistance, excellent sulfide stress corrosion cracking resistance and excellent sulfide stress cracking resistance even in a severe corrosive environment of high temperature of 200° C. or above and containing $CO_2$, $Cl^-$ and $H_2S$. Accordingly, we can acquire industrially remarkable advantageous effects.

DETAILED DESCRIPTION

First, reasons for limiting the contents of respective constitutional elements of the high-strength seamless stainless steel pipe are explained. Unless otherwise specified, mass % in the composition is simply indicated by "%" hereinafter.

C: 0.05% or Less

C is an important element to increase the strength of martensite-based stainless steel. It is desirable that the content of C is 0.012% or more to ensure a predetermined strength. However, when the content of C exceeds 0.05%, corrosion resistance is deteriorated. Accordingly, the content of C is 0.05% or less. The content of C is preferably 0.04% or less. Although the content of C is not particularly limited, the content of C is preferably 0.012% or more, the content of C is more preferably 0.015% or more, and the content of C is further more preferably 0.02% or more.

Si: 1.0% or Less

Si is an element that functions as a deoxidizing agent. To acquire such a deoxidizing effect, it is desirable for the content of Si to be 0.005% or more. On the other hand, when the content of Si is large and exceeds 1.0%, hot workability is deteriorated. Accordingly, the content of Si is 1.0% or less. The content of Si is preferably 0.8% or less, the content of Si is more preferably 0.6% or less and the content of Si is further more preferably 0.4% or less. Although the content of Si is not particularly limited, the content of Si is preferably 0.005% or more, the content of Si is more preferably 0.01% or more and the content of Si is further more preferably 0.1% or more.

Mn: 0.1 to 0.5%

Mn is an element that increases strength of martensitic stainless steel. To ensure desired strength of martensitic stainless steel, it is necessary for the content of Mn to be 0.1% or more. On the other hand, when the content of Mn exceeds 0.5%, toughness is deteriorated. Accordingly, the content of Mn is 0.1 to 0.5%. The content of Mn is preferably 0.4% or less. The content of Mn is more preferably 0.3% or less. Further, the content of Mn is preferably 0.10% or more, and the content of Mn is more preferably 0.15% or more.

P: 0.05% or Less

P is an element that deteriorates corrosion resistances such as carbon dioxide gas corrosion resistance, and sulfide stress cracking resistance. Hence, it is preferable to decrease the content of P as much as possible. However, it is permissible that the content of P is 0.05% or less. Accordingly, the content of P is 0.05% or less. The content of P is preferably 0.04% or less, the content of P is more preferably 0.03% or less, and the content of P is further more preferably 0.02% or less.

s: 0.005% or Less

S is an element that remarkably deteriorates hot workability and impedes stable operation of a hot pipe forming step. Hence, it is preferable to decrease the content of S as much as possible. However, when the content of S is 0.005% or less, a pipe can be manufactured in an ordinary step. Accordingly, the content of S is 0.005% or less. The content of S is preferably 0.003% or less, and the content of S is more preferably 0.002% or less.

Cr: More than 16.0% to 18.0% or Less

Cr is an element forming a protective film thus contributing to enhancement of corrosion resistance. When the content of Cr is 16.0% or less, desired corrosion resistance cannot be ensured. Hence, it is necessary for the content of Cr to be more than 16.0%. On the other hand, when the content of Cr exceeds 18.0%, the fraction of ferrite becomes excessively high so that desired high strength cannot be ensured. Accordingly, the content of Cr is more than 16.0% to 18.0% or less. The content of Cr is preferably 16.1 to 17.5%. The content of Cr is more preferably 16.2 to 17.0%.

Mo: More than 2.0% to 3.0% or Less

Mo is an element that stabilizes a protective film thus improving resistance to pitting corrosion caused by $Cl^-$ and low pH so that Mo enhances sulfide stress cracking resistance and sulfide stress corrosion cracking resistance. To acquire these effects, it is necessary for the content of Mo to be more than 2.0%. On the other hand, Mo is an expensive element. Hence, when the content of Mo exceeds 3.0%, material cost is sharply pushed up and, at the same time, Mo deteriorates toughness and sulfide stress corrosion cracking resistance of steel. Accordingly, the content of Mo is more than 2.0% to 3.0% or less. The content of Mo is preferably 2.2 to 2.8%.

Cu: 0.5 to 3.5%

Cu is an element that strengthens a protective film, thereby suppressing intrusion of hydrogen into the steel so that Cu enhances sulfide stress cracking resistance and sulfide stress corrosion cracking resistance. To acquire these effects, it is necessary for the content of Cu to be 0.5% or more. On the other hand, when the content of Cu exceeds 3.5%, grain boundary precipitation of CuS is brought about so that hot workability is deteriorated. Accordingly, the content of Cu is 0.5 to 3.5%. The content of Cu is preferably 0.5 to 3.0%. The content of Cu is more preferably 0.8% or more and less than 2.8%.

Ni: 3.0% or More and Less than 5.0%

Ni is an element that strengthens a protective film thus contributing to enhancement of corrosion resistance. Ni is also an element that increases strength of steel by solid solution strengthening. These effects become apparent when the content of Ni is 3.0% or more. On the other hand, when the content of Ni is 5.0% or more, stability of martensitic phase is deteriorated. Hence, strength is lowered. Accordingly, the content of Ni is 3.0% or more and less than 5.0%. The content of Ni is preferably 3.5 to 4.5%.

W: 0.01 to 3.0%

W is an important element that contributes to enhancement of strength of steel and enhances sulfide stress cracking resistance and sulfide stress corrosion cracking resistance by stabilizing a protective film. W is contained in the steel in the form of a composite with Mo. Hence, W particularly remarkably enhances sulfide stress cracking resistance. To acquire these effects, it is necessary for the content of W to be 0.01% or more. On the other hand, when the content of W is large and exceeds 3.0%, toughness is deteriorated. Accordingly, the content of W is 0.01 to 3.0%. The content of W is preferably 0.5 to 2.0%. The content of W is more preferably 0.8 to 1.3%.

Nb: 0.01 to 0.5%

Nb is an element bonded with C and N and precipitates in the form of Nb carbonitride (Nb precipitates), pins a crystal grain boundary, and prevents crystal grains from becoming coarse when heated in hot rolling particularly. Nb is an important element that contributes to refining of crystal grains in relation to C, N and Ti. To acquire these effects, it is necessary for the content of Nb to be 0.01% or more. On the other hand, when the content of Nb is large and exceeds 0.5%, toughness and sulfide stress cracking resistance are deteriorated. Accordingly, the content of Nb is 0.01 to 0.5%. The content of Nb is preferably 0.02% or more. The content of Nb is more preferably 0.06% or more. The content of Nb is preferably 0.3% or less, and the content of Nb is more preferably 0.1% or less.

Ti: 0.001 to 0.3%

Ti is an element bonded with C and N and precipitates in the form of Ti carbonitride (Ti precipitate), pins a crystal grain boundary, and prevents crystal grains from becoming coarse when heated in hot rolling particularly. Ti is an important element that contributes to refining of crystal grains in relation to C, N and Nb. To acquire these effects, it is necessary for the content of Ti to be 0.001% or more. On the other hand, when the content of Ti is large and exceeds 0.3%, toughness and sulfide stress cracking resistance are deteriorated. Accordingly, the content of Ti is 0.001 to 0.3%. The content of Ti is preferably 0.001 to 0.1%, and the content of Ti is more preferably 0.001 to 0.01%.

By allowing the composition of the seamless steel pipe to contain Ti together with Nb, precipitation temperatures of Nb precipitate and Ti precipitate are increased and, at the same time, precipitation amounts of Nb precipitate and Ti precipitate are increased. Hence, an effect of pinning a crystal grain boundary is further enhanced.

Al: 0.001 to 0.1%

Al is an element that functions as a deoxidizing agent. To acquire such a deoxidizing effect, it is necessary for the content of Al to be 0.001% or more. On the other hand, when the content of Al is large and exceeds 0.1%, an amount of oxide is increased so that cleanliness is lowered whereby toughness is deteriorated. Accordingly, the content of Al is 0.001 to 0.1%. The content of Al is preferably 0.01 to 0.07%. The content of Al is more preferably 0.02 to 0.04%.

N: Less than 0.07%

N is an element that enhances pitting corrosion resistance. To acquire such an effect, it is desirable for the content of N to be 0.012% or more. However, when the content of N is 0.07% or more, N forms nitride thus deteriorating toughness. Accordingly, the content of N is less than 0.07%. The content of N is preferably 0.02 to 0.06%.

O: 0.01% or Less

O (oxygen) is present in steel in the form of an oxide. Hence, O adversely affects various properties. Accordingly, it is preferable to decrease the content of O as much as possible. Particularly, when the content of O exceeds 0.01%, hot workability, corrosion resistance and toughness are deteriorated. Accordingly, the content of O is 0.01% or less. The content of O is preferably 0.006% or less, and the content of O is more preferably 0.003% or less.

The above-mentioned components are basic components, while it is possible to use a composition containing, as selective elements, one kind or two or more kinds selected from a group consisting of 0.5% or less V, 0.2% or less Zr, 1.4% or less Co, 0.1% or less Ta, and 0.0050% or less B and/or one kind or two kinds selected from a group consisting of 0.0005 to 0.0050% Ca, and 0.001 to 0.01% REM adding to the basic composition.

One Kind or Two or More Kinds Selected from a Group Consisting of 0.5% or Less V, 0.2% or Less Zr, 1.4% or Less Co, 0.1% or Less Ta, and 0.0050% or Less B All of V, Zr, Co, Ta and B are elements that increase the strength of steel, and the steel raw material can contain at least one kind of these elements selectively when required. In addition to the above-mentioned effect, V, Zr, Co, Ta and B also have an effect of improving sulfide stress corrosion cracking resistance. To acquire these effects, it is desirable that the steel raw material contain one kind or two or more kinds selected from a group consisting of 0.01% or more V, 0.01% or more Zr, 0.01% or more Co, 0.01% or more Ta, and 0.0003% or more B. On the other hand, when the content of V exceeds 0.5%, the content of Zr exceeds 0.2%, the content of Co exceeds 1.4%, the content of Ta exceeds 0.1% and the content of B exceeds 0.0050%, toughness of steel is deteriorated. Accordingly, when the steel raw material contains V, Zr, Co, Ta and B, it is preferable for the content of V to be 0.5% or less, the content of Zr to be 0.2% or less, the content of Co to be 1.4% or less, the content of Ta to be 0.1% or less, and the content of B to be 0.0050% or less. It is more preferable for the content of V to be 0.1% or less, the content of Zr to be 0.1% or less, the content of Co to be 0.1% or less, the content of Ta to be 0.05% or less and the content of B to be 0.0030% or less.

One Kind or Two Kinds Selected from a Group Consisting of 0.0005 to 0.0050% Ca, and 0.001 to 0.01% REM Both of Ca and REM (rare earth metal) are elements contributing to improvement of sulfide stress corrosion cracking resistance by way of shape control of sulfide, and the steel raw material can contain one kind or two kinds of these elements when required. To acquire such an effect, it is desirable that the steel raw material contain one kind or two kinds selected from a group consisting of 0.0005% or more Ca and 0.001% or more REM. On the other hand, even when the content of Ca exceeds 0.0050% and the content of REM exceeds 0.01%, the effect is saturated so that an amount of effect which corresponds to the contents of Ca and REM cannot be expected. Accordingly, when the steel raw material contains Ca, REM, it is preferable for the content of Ca to be 0.0005 to 0.0050% and the content of REM to be 0.001 to 0.01% respectively.

The balance other than the above-mentioned components is formed of Fe and unavoidable impurities.

Next, the reason of limiting the microstructure of the high-strength seamless stainless steel pipe is explained.

The high-strength seamless stainless steel pipe has the above-mentioned composition, and has the microstructure formed of tempered martensite phase forming a main phase, 20 to 40% of ferrite phase in terms of volume ratio, and 25% or less of residual austenite phase in terms of volume ratio. "Main phase" means a phase that occupies the microstructure exceeding 40% in terms of volume ratio.

In the high-strength seamless stainless steel pipe, to ensure desired high strength, tempered martensite phase forms a main phase. Further, as a second phase, a ferrite phase is precipitated at least at a volume ratio of 20% or more. Therefore, the progress of corrosion cracking can be suppressed. Hence, desired corrosion resistance can be ensured. On the other hand, when a precipitation amount of ferrite phase is large and exceeds 40%, strength of the steel pipe is lowered so that the steel pipe cannot ensure desired high strength and, at the same time, sulfide stress corrosion cracking resistance and sulfide stress cracking resistance are deteriorated. Accordingly, an amount of ferrite phase is 20 to 40% in terms of volume ratio.

An average grain size of the ferrite phase is 40 μm or less. When the average grain size of the ferrite phase is large and exceeds 40 μm, toughness is deteriorated.

Further, as a second phase, in addition to the ferrite phase, an austenite phase (residual austenite phase) is also precipitated at a volume ratio of 25% or less. Due to the presence of the residual austenite phase, ductility and toughness are enhanced. To acquire such advantageous effects, it is desirable to make 5% or more of the residual austenite phase in terms of volume ratio precipitate. On the other hand, when a large amount of residual austenite phase exceeding 25% in terms of volume ratio precipitates, desired high strength cannot be ensured. Accordingly, the amount of residual austenite phase is 25% or less in terms of volume ratio. It is preferable that the amount of residual austenite phase is 5 to 15% in terms of volume ratio.

The high-strength seamless stainless steel pipe has, in addition to the above-mentioned respective phases, the microstructure where Ti precipitates and Nb precipitates having a grain size of 2 μm or less are precipitated. A sum of amounts of Ti and Nb precipitated as precipitates is 0.06 mass % or more. By making the Ti precipitates and Nb precipitates having a grain size of 2 μm or less precipitate in the microstructure, the steel pipe can obtain both desired high strength and desired high toughness. To acquire such advantageous effects, it is necessary to set amounts of Ti precipitates and Nb precipitates having a grain size of 2 μm or less such that a sum of amounts of precipitated Ti and Nb becomes 0.06% or more by mass % with respect to a total amount of the microstructure. Ti precipitates and Nb precipitates having a grain size larger than 2 μm contribute little to the enhancement of strength and, hence, amounts of Ti precipitates and Nb precipitates having a grain size larger than 2 μm are not particularly limited.

Next, a preferred method of manufacturing a high-strength seamless stainless steel pipe having the above-mentioned composition and the microstructure is explained.

The method of manufacturing a high-strength seamless stainless steel pipe includes: a heating step of heating a steel pipe raw material (starting raw material); a hot pipe forming step of forming a seamless steel pipe by applying hot pipe forming to the steel pipe raw material heated in the heating step; a cooling step of cooling the seamless steel pipe obtained in the hot pipe forming step; and a heat treatment step of applying quenching treatment to the seamless steel pipe cooled in the cooling step and subsequently applying tempering treatment to the seamless steel pipe.

A steel pipe raw material having the above-mentioned composition is used as a starting raw material.

Our method of manufacturing the starting raw material is not particularly limited, and any one of usually known methods of manufacturing a steel pipe raw material can be used. As a method of manufacturing the starting raw material, for example, it is preferable to adopt a method where molten steel having the above-mentioned composition is made by a usual molten steel making method which uses a converter or the like, and the molten steel can be formed into cast slab (steel pipe raw materials) such as billets by a usual casting method such as a continuous casting method. The method of manufacturing the starting raw material is not limited to this method. Further, no problem arises in using, as a steel pipe raw material, a billet having a desired size and a desired shape which is prepared by applying additional hot rolling to a cast slab.

Then, these steel pipe raw materials are heated and subjected to hot pipe forming of a Mannesmann-plug mill process or Mannesmann-mandrel mill process thus forming seamless steel pipes having the above-mentioned compositions and desired sizes. The hot pipe forming may be performed by hot extrusion using a press.

A heating temperature (T(° C.)) in the heating step is 1210 to 1350° C. When the heating temperature T is below 1210° C., hot workability is deteriorated. Hence, flaws are generated on a seamless steel pipe during pipe forming. On the other hand, when the heating temperature T becomes a high temperature exceeding 1350° C., a single ferrite phase is formed. Further, an amount of Ti precipitates and an amount of Nb precipitates are decreased. Hence, a desired pinning effect cannot be ensured whereby crystal grains become coarse thus deteriorating low-temperature toughness. Accordingly, the heating temperature T is 1210 to 1350° C.

A heating temperature T falls within the above-mentioned range, and an average grain size A (μm) of Ti precipitates and Nb precipitates at the heating temperature T and a sum of amounts B (mass %) of Ti precipitates and Nb precipitates satisfy formula (1)

$$A/B^{2/3} \leq 14.0 \quad (1)$$

wherein, A: average grain size (μm) of Ti precipitates and Nb precipitates at heating temperature T B: sum of amounts (mass %) of precipitated Ti and Nb at heating temperature T.

That is, higher heating temperature T in the heating step is preferable in view of enhancing hot workability and suppressing flaws generated on the seamless steel pipe during pipe forming. However, when the heating temperature T in the heating step becomes high, a sum of amounts of T precipitates and Nb precipitates is decreased (that is, the left side of formula (1) is increased), and a desired pinning effect of the ferrite grains cannot be expected. Hence, the ferrite grains become coarse. A heating temperature T in the heating step is 1210 to 1350° C., and at which formula (1) is satisfied. Therefore, flaws generated on the seamless steel pipe during pipe forming can be suppressed, and coarsening of the ferrite grains can be suppressed thus also suppressing deteriorating of low-temperature toughness of a finished product. The smaller the value of the left side of formula (1) becomes, the finer the ferrite grains become. It is preferable to set $A/B^{2/3}$ to 10.0 or less, and it is more preferable to set $A/B^{2/3}$ to 8.0 or less.

A value of $A/B^{2/3}$ in formula (1) can be obtained by cooling a steel pipe raw material by applying water cooling or the like after heating the steel pipe raw material at the heating temperature T and measuring an average grain size (μm) of Ti precipitates and Nb precipitates present in the steel pipe raw material after cooling and a sum of amounts (mass %) of Ti and Nb precipitated as precipitates. A method of measuring the average grain size (μm) of the Ti precipitates and Nb precipitates and a method of measuring the sum of amounts (mass %) of precipitated Ti and Nb are described in detail in the description of examples.

Although the heating time in the heating step is not particularly limited, for example, the heating time is 15 minutes to 2 hours. The heating time is preferably 30 minutes to 1 hour.

In the hot pipe forming step, usual hot pipe forming of a Mannesmann-plug mill process, a Mannesmann-mandrel mill process or the like is applied to the steel pipe raw material heated in the heating step to form a seamless steel pipe having a desired size. It is sufficient that a seamless steel pipe having a desired size can be manufactured by the hot pipe forming. Hence, it is not necessary to regulate the condition of hot pipe forming, and any usual manufacturing condition is applicable.

The seamless steel pipe prepared by the hot pipe forming step is cooled in the cooling step. It is not necessary to particularly limit the cooling condition in the cooling step. Provided that the seamless steel pipe has the composition falling within the desired composition range, it is possible to make the microstructure of the seamless steel pipe into a microstructure containing a martensite phase forming a main phase by cooling the seamless steel pipe to a room temperature at a cooling rate of air cooling after hot pipe forming.

In a heat treatment step following the cooling step, heat treatment formed of quenching treatment and tempering treatment is further performed.

It is preferable to perform quenching treatment such that the seamless steel pipe cooled in the cooling step is heated to a heating temperature of 850° C. or above and, thereafter, the seamless steel pipe is cooled to a cooling stop temperature of 50° C. or below at a cooling rate of air cooling or more. When the heating temperature of quenching treatment is below 850° C., the reverse transformation from martensite to austenite rarely occurs and the transformation from austenite to martensite rarely occurs during cooling where the seamless steel pipe is cooled to a cooling stop temperature. Accordingly, desired high strength cannot be ensured. On the other hand, when the heating temperature is excessively high exceeding 1050° C., with respect to Ti and Nb precipitates having a grain size of 2 μm or less which precipitate in the microstructure of a final product, it becomes difficult for the microstructure to ensure a sufficient amount of the Ti and Nb precipitates. Accordingly, it is preferable for the heating temperature in quenching treatment to be 850 to 1050° C. It is more preferable to set a heating temperature in quenching treatment to 900 to 1000° C. By setting the heating temperature in quenching treatment to the value falling within the above-mentioned temperature range, a volume ratio of a ferrite phase can be easily adjusted to a value falling within an appropriate range. When a cooling stop temperature in quenching treatment is an excessively low value, it becomes difficult to adjust the amount of residual austenite phase within a proper range.

It is preferable to perform tempering treatment such that a seamless steel pipe by quenching treatment is heated at a tempering temperature of 500 to 650° C. and, thereafter, the seamless steel pipe is cooled by natural cooling. When the tempering temperature is below 500° C., the tempering temperature is excessively low so that there may be a concern that a desired tempering effect cannot be expected. On the other hand, when the tempering temperature is excessively high exceeding 650° C., a martensite phase held in a quenched state is formed so that there is a concern where a seamless steel pipe cannot satisfy the desired high strength and high toughness as well as excellent corrosion resistance simultaneously. It is preferable for the tempering temperature to be 550 to 630° C.

By applying the above-mentioned heat treatment to the seamless steel pipe, the microstructure of the seamless steel pipe is formed into a microstructure including a tempered martensite phase, a ferrite phase and a residual austenite phase where the tempered martensite phase forms a main phase. Therefore, it is possible to provide a high-strength seamless steel pipe having the desired high strength, high toughness and excellent corrosion resistance.

Our pipes and methods are further described based on examples.

EXAMPLES

Molten steel having the composition shown in Table 1 was made by a converter, and molten steel was formed into billets (cast slabs: steel pipe raw materials) by a continuous casting method. A heating step of heating the obtained steel pipe raw materials (steel slabs) to heating temperatures T described in Table 2 was performed. Heating was performed at a heating temperature T for 30 minutes.

Then, the steel pipe raw materials heated in the above-mentioned heating step were formed into seamless steel pipes (outer diameter: 83.8 mmϕ, wall thickness: 12.7 mm) by pipe forming (hot pipe forming) using a model seamless mill. The seamless steel pipes were cooled by air cooling after pipe forming. The presence or non-presence of rolling flaws on the obtained seamless steel pipes was checked in accordance with a regulation stipulated in ISO 13680. To be more specific, presence or non-presence of rolling flaws was checked by visually observing an outer surface of the seamless steel pipe. Next, a cross section of the seamless steel pipe having the rolling flaws was exposed by cutting, and depths of the flaws on the cross section were measured by an optical microscope. Then, the evaluation "disqualified" was given to the seamless steel pipes when rolling flaws having a depth of 0.635 mm or more occurred on an outer surface of the seamless steel pipe, and the evaluation "qualified: ○" was given to other seamless steel pipes.

An experiment was performed such that specimens (size: 50 mm×50 mm×15 mm) were sampled from the above-mentioned respective steel pipe raw materials before a heating step was applied to the seamless steel pipes, the specimens were heated at a heating temperature T for 30 minutes, and the specimens were cooled by water cooling. Thin films prepared for a scanning electron microscope were sampled from the specimens after cooling. The thin films were observed by a scanning microscope (magnification: 5000 times). That is, with respect to Ti and Nb precipitates having grain sizes of 0.01 μm or more, the grain sizes of these precipitates were measured, and average grain sizes A (μm) of Ti and Nb precipitates were calculated by an arithmetic mean operation. The number of measured Ti and Nb precipitates was 30 or more for each specimen. Further, specimens for electrolytic extraction were sampled from the specimens after cooling, and were processed by electrolytic extraction in an electrolytic solution (10 vol % acetylacetone-1 mass % tetramethyl ammonium chloride-methanol solution (hereinafter also referred to as "10% AA solution")), and a residue which remained after filtering through meshes of 0.2 μm was subjected to an ICP (Inductively Coupled Plasma Atomic Emission Spectroscopy) analysis to analyze an amount of Ti and an amount of Nb in the residue. In the ICP analysis, the amount of Ti and the amount of Nb in the residue were converted into ratios of the amount of Ti and the amount of Nb to a mass of the specimen for electrolytic extraction, and were set as precipitation amounts of Ti and Nb precipitated in the specimen. A left side of formula (1) was calculated based on the obtained values and the satisfaction or dissatisfaction of formula (1) was determined. A result of determination is shown in Table 2. When neither Ti precipitates nor Nb precipitates were precipitated or a precipitation amount of precipitated Ti and Nb was less than a limit amount which enables detection, an average grain size A and a precipitation amount B of Ti precipitates and Nb precipitates is indicated by "-" in Table 2. With respect to the presence or the non-presence of satisfaction of formula (1), in Table 2, "satisfied" means that formula (1) was satisfied, and "not satisfied" means that formula (1) was not satisfied, or neither Ti precipitates nor Nb precipitates were precipitated, or precipitation amounts of precipitated Ti and Nb were less than a limit amount which enables detection so that the applying of formula (1) was substantially difficult.

Next, specimen raw materials were cut out from the obtained seamless steel pipes. The specimen raw materials were subjected to quenching treatment where the specimen raw materials were heated to heating temperatures shown in Table 2 and cooled by water cooling after heating and tempering treatment where the specimen raw materials were heated to heating temperatures shown in Table 2 and cooled by air cooling (natural cooling) after heating. That is, the specimen raw materials correspond to materials obtained by applying the quenching treatment and the tempering treatment to the seamless steel pipe.

Then, specimens were sampled from the specimen raw materials, and a structure observation, a tensile test, an impact test, measurement of precipitates, and a corrosion resistance test were performed. The testing methods were as follows.

(1) Structure Observation

Specimens for structure observation were sampled from obtained specimen raw materials such that a cross section in a pipe axis direction becomes an observation surface. The obtained specimens for structure observation were corroded using a Vilella reagent (mixed solution of 100 mL of ethanol, 10 mL of hydrochloric acid and 2 g of picric acid). The microstructures were imaged by a scanning electron microscope (magnification: 1000 times), and a volume ratio of ferrite phase (volume %) calculated using an image analyzer. Further, an average grain size of a ferrite phase was measured by a cutting method in accordance with JIS G 0551.

Further, from the obtained specimen raw materials, specimens for X-ray diffraction were sampled such that a cross section orthogonal to the pipe axis direction (C cross section) forms a measurement surface, and a volume ratio of residual austenite phase was measured using an X-ray diffraction method. By the X-ray diffraction, diffracted X-ray integrated intensities of a (220) plane of γ and a (211) plane of α were measured and conversion was performed using the following relationship $$\gamma(\text{volume ratio})=100/(1+(I\alpha R\gamma/I\gamma R\alpha))$$

(wherein, Iα is integral intensity of α, Rα is crystallographical theoretic calculation value of α, Iγ is integral intensity of γ, Rγ is crystallographical theoretic calculation value of γ). A volume ratio of martensite phase was calculated as a volume ratio of a balance other than these phases.

(2) Tensile Test

Strip specimens specified by API standard 5CT were sampled from the obtained specimen raw materials such that the pipe-axis direction is aligned with the pulling direction. The tensile test was performed in accordance with API5CT, and tensile properties (yield strength YS, tensile strength TS) were obtained. "API" is an abbreviation of American Petroleum Institute.

(3) Impact Test

In accordance with JIS Z 2242, V-notched specimens (thickness of 10 mm) were sampled from the obtained specimen raw materials such that the longitudinal direction of the specimen is aligned with the pipe-axis direction, and the Charpy impact test was performed. The test temperature was set to −10° C., and an absorbing energy value $vE_{-10}$ at −10° C. was obtained, and toughness was evaluated. Three specimens were used in each test, and an arithmetic mean of the obtained values was set as an absorbing energy value (J) of the high-strength seamless stainless steel pipe.

(4) Measurement of Precipitates

Specimens for electrolytic extraction were sampled from the obtained specimen raw materials and were processed by electrolytic extraction in an electrolytic solution (10% AA solution), and a residue which remained after filtering through meshes of 0.2 μm was obtained. The residue was subjected to an ICP analysis to analyze an amount of Ti and Nb in the residue, and the amount of Ti and Nb in the residue was converted into ratio of the amount of Ti and Nb to a mass of the specimen for electrolytic extraction, and the ratio was set as a total amount α(mass %) of Ti and Nb precipitated in the specimen as Ti precipitates and Nb precipitates. Further, specimens for electrolytic extraction were sampled from the obtained specimen raw materials in the same manner and processed by electrolytic extraction in an electrolytic solution (10% AA solution), and a residue which remained after filtering through meshes of 2 μm was subjected to an ICP analysis in the same manner to analyze an amount of Ti and Nb in the residue, and the amount of Ti and Nb in the residue was converted into a ratio of the amount of Ti and Nb to a mass of the specimen for electrolytic extraction, and the ratio was set as a total amount β (mass %) of Ti and Nb precipitated in the specimens as Ti precipitates and Nb precipitates having grain sizes exceeding 2 μm. Then, the difference between a and β was obtained, and this difference was set as a precipitation amount (mass %) of Ti and Nb precipitated as precipitates having a grain size of 2 μm or less.

(5) Corrosion Resistance Test

Specimens for corrosion test having a thickness of 3 mm, a width of 30 mm and a length of 40 mm were prepared from the obtained specimen raw materials by machining, a corrosion test was performed, and carbon dioxide gas corrosion resistance was evaluated.

The corrosion test was performed by immersing the specimen for corrosion test in 20% NaCl aqueous solution (solution temperature: 200° C., $CO_2$ gas atmosphere of 30 atmospheric pressure) which is a test solution held in an autoclave, and by setting an immersion period to 14 days (336 hours). The mass of the specimen for corrosion test was measured before and after the corrosion test, and a corrosion rate was calculated from the difference between the weights of the specimen before and after the corrosion test. With respect to the specimens for corrosion test which were already subjected to the corrosion test, the presence or non-presence of the occurrence of pitting on a surface of the specimen for corrosion test was observed using a loupe having the magnification of 10 times. It is determined that pitting is present when pitting having a diameter of 0.2 mm or more is observed. In other cases, it is determined that pitting is not present.

Round rod specimens (diameter: 6.4 mmϕ) were prepared from the obtained specimen raw materials by machining, and the specimens were subjected to a sulfide stress cracking resistance test (SSC resistance test) in accordance with NACE TM0177 Method A. "NACE" is an abbreviation of National Association of Corrosion Engineering.

4-point bending specimens having a thickness of 3 mm, a width of 15 mm and a length of 115 mm were sampled by machining from the obtained specimen raw materials, and the specimens were subjected to a sulfide stress corrosion cracking resistance test (SCC resistance test) in accordance with EFC17. "EFC" is an abbreviation of European Federal of Corrosion.

The SCC resistance test was performed such that specimens were immersed into an aqueous solution whose pH is adjusted to 3.3 by adding an acetic acid and sodium acetate into a test solution (20% NaCl aqueous solution (solution temperature: 100° C., $H_2S$ of 0.1 atmospheric pressure, $CO_2$ of 30 atmospheric pressure)) held in an autoclave, an immersion period was set to 720 hours, and 100% of yield stress applied as a load stress. With respect to the specimens already subjected to the SCC resistance test, the presence or non-presence of cracking was observed.

The SSC resistance test was performed such that specimens were immersed into an aqueous solution whose pH is adjusted to 3.5 by adding an acetic acid and sodium acetate into a test solution (20% NaCl aqueous solution (solution temperature: 25° C., $H_2S$ of 0.1 atmospheric pressure, $CO_2$ of 0.9 atmospheric pressure)) held in an autoclave, an immersion period was set to 720 hours, and 90% of yield stress applied as a load stress. With respect to the specimens already subjected to the SSC resistance test, the presence or non-presence of cracking was observed.

The obtained results are shown in Table 3.

TABLE 1

| | Chemical compositions (mass %) | | | | | | | | | | | | | | | | | |
|---|---|---|---|---|---|---|---|---|---|---|---|---|---|---|---|---|---|---|
| Steel No. | C | Si | Mn | P | S | Cr | Mo | Cu | Ni | W | Nb | Ti | Al | N | O | V, B, Zr, Co, Ta | Ca, REM | Remarks |
| A | 0.027 | 0.24 | 0.21 | 0.017 | 0.0007 | 16.3 | 2.54 | 0.96 | 4.2 | 1.03 | 0.089 | 0.002 | 0.037 | 0.037 | 0.0017 | V: 0.04 | — | our example |
| B | 0.033 | 0.21 | 0.26 | 0.017 | 0.0007 | 16.6 | 2.64 | 0.94 | 3.7 | 1.09 | 0.088 | 0.003 | 0.034 | 0.053 | 0.0021 | V: 0.04 | — | our example |
| C | 0.034 | 0.23 | 0.23 | 0.017 | 0.0007 | 16.7 | 2.58 | 0.92 | 4.1 | 1.02 | 0.091 | 0.004 | 0.033 | 0.048 | 0.0022 | V: 0.04, B: 0.002, Zr: 0.032, Co: 0.07, Ta: 0.025 | Ca: 0.0029, REM: 0.008 | our example |
| D | 0.020 | 0.26 | 0.07 | 0.011 | 0.0011 | 16.1 | 2.15 | 2.82 | 4.1 | 0.46 | — | — | 0.039 | 0.009 | 0.0017 | Zr: 0.18, Co: 0.34 | — | comparison example |

TABLE 1-continued

| Steel No. | Chemical compositions (mass %) C | Si | Mn | P | S | Cr | Mo | Cu | Ni | W | Nb | Ti | Al | N | O | V, B, Zr, Co, Ta | Ca, REM | Remarks |
|---|---|---|---|---|---|---|---|---|---|---|---|---|---|---|---|---|---|---|
| E | 0.023 | 0.22 | 0.25 | 0.015 | 0.0007 | 16.2 | 2.48 | 0.98 | 4.2 | 0.97 | 0.087 | — | 0.038 | 0.038 | 0.0018 | V: 0.05 | — | comparison example |
| F | 0.023 | 0.27 | 0.23 | 0.018 | 0.0007 | 17.2 | 2.55 | 0.88 | 3.7 | 0.87 | 0.093 | 0.002 | 0.033 | 0.048 | 0.0013 | — | — | our example |
| G | 0.031 | 0.26 | 0.19 | 0.018 | 0.0007 | 16.1 | 2.57 | 0.90 | 4.4 | 1.10 | 0.050 | 0.002 | 0.033 | 0.041 | 0.0018 | V: 0.05 | — | our example |
| H | 0.026 | 0.25 | 0.21 | 0.015 | 0.0008 | 16.2 | 2.76 | 0.90 | 4.1 | 0.93 | 0.070 | 0.002 | 0.039 | 0.020 | 0.0020 | V: 0.03 | — | our example |
| I | 0.024 | 0.24 | 0.08 | 0.011 | 0.0010 | 16.9 | 2.55 | 2.70 | 4.4 | 0.50 | 0.020 | — | 0.038 | 0.010 | 0.0018 | — | — | comparison example |
| J | 0.021 | 0.25 | 0.22 | 0.014 | 0.0007 | 16.8 | 2.31 | 0.89 | 3.7 | 1.02 | 0.072 | 0.002 | 0.038 | 0.046 | 0.0018 | — | Ca: 0.0025 | our example |

Underlined steels falling outside our scope.

TABLE 2

| Steel pipe No. | Steel No. | Heating step: Heating temperature T (° C.) | Average grain size A (μm) of Ti, Nb precipitates | Precipitation amount B (mass %) of Ti, Nb precipitates | Value of left side of formula (1)* | Whether or not formula -1 was satisfied |
|---|---|---|---|---|---|---|
| 1 | A | 1250 | 0.23 | 0.008 | 5.8 | satisfied |
| 2 | B | 1250 | 0.18 | 0.019 | 2.5 | satisfied |
| 3 | C | 1250 | 0.17 | 0.017 | 2.6 | satisfied |
| 4 | D | 1250 | — | — | — | not satisfied |
| 5 | E | 1250 | — | — | — | not satisfied |
| 6 | F | 1250 | 0.16 | 0.017 | 2.4 | satisfied |
| 7 | G | 1250 | 0.22 | 0.004 | 8.7 | satisfied |
| 8 | H | 1300 | 0.3 | 0.002 | 18.9 | not satisfied |
| 9 | I | 1250 | — | — | — | not satisfied |
| 10 | J | 1250 | 0.19 | 0.008 | 4.8 | satisfied |

| Steel pipe No. | Quenching treatment: Heating temperature (° C.) | Holding time (minutes) | Cooling | Tempering treatment: Heating temperature (° C.) | Holding time (minutes) | Cooling | Remarks |
|---|---|---|---|---|---|---|---|
| 1 | 960 | 20 | water cooling** | 630 | 30 | air cooling | our example |
| 2 | 960 | 20 | water cooling | 600 | 30 | air cooling | our example |
| 3 | 960 | 20 | water cooling | 600 | 30 | air cooling | our example |
| 4 | 980 | 20 | water cooling | 550 | 30 | air cooling | comparison example |
| 5 | 960 | 20 | water cooling | 630 | 30 | air cooling | comparison example |
| 6 | 960 | 20 | water cooling | 630 | 30 | air cooling | our example |
| 7 | 1070 | 20 | water cooling | 630 | 30 | air cooling | comparison example |
| 8 | 960 | 20 | water cooling | 630 | 30 | air cooling | comparison example |
| 9 | 980 | 20 | water cooling | 550 | 30 | air cooling | comparison example |
| 10 | 960 | 20 | water cooling | 630 | 30 | air cooling | our example |

Underlined steels falling outside our scope.

*$A/B^{2/3} \leq 14.0$ . . . (1)

**stop cooling temperature in water cooling 100° C. or below

TABLE 3

| Steel pipe No. | Steel No. | Rolling flaws | Microstructure: Kind* | F phase volume ratio (%) | Residual γ phase volume ratio (%) | Average grain size (μm) of F phase | Ti, Nb precipitates** Amount of precipitate (mass %) | Tensile property: Yield strength YS (MPa) | Tensile strength TS (MPa) |
|---|---|---|---|---|---|---|---|---|---|
| 1 | A | qualifiedO | TM + F + γ | 30 | 10 | 22 | 0.07 | 822 | 993 |
| 2 | B | qualifiedO | TM + F + γ | 26 | 8 | 18 | 0.07 | 896 | 1002 |
| 3 | C | qualifiedO | TM + F + γ | 29 | 8 | 23 | 0.1 | 873 | 1033 |
| 4 | D | qualifiedO | TM + F + γ | 32 | 2 | 54 | — | 855 | 1080 |
| 5 | E | qualifiedO | TM + F + γ | 28 | 8 | 51 | 0.05 | 800 | 942 |
| 6 | F | qualifiedO | TM + F + γ | 27 | 8 | 17 | 0.08 | 822 | 974 |
| 7 | G | qualifiedO | TM + F + γ | 33 | 11 | 32 | 0.05 | 819 | 949 |
| 8 | H | qualifiedO | TM + F + γ | 29 | 12 | 46 | 0.07 | 848 | 934 |
| 9 | I | qualifiedO | TM + F + γ | 26 | 2 | 44 | — | 867 | 1086 |
| 10 | J | qualifiedO | TM + F + γ | 34 | 11 | 22 | 0.07 | 817 | 973 |

| Steel pipe No. | Toughness $vE_{-10}$ (J) | Corrosion Test: Reduction of amount by corrosion (mm/y) | Presence or non-presence of pitting | SSC resistance test Presence or non-presence of cracking | SCC resistance test Presence or non-presence of cracking | Remarks |
|---|---|---|---|---|---|---|
| 1 | 118 | 0.097 | not present | not present | not present | our example |
| 2 | 93 | 0.102 | not present | not present | not present | our example |
| 3 | 109 | 0.103 | not present | not present | not present | our example |
| 4 | 29 | 0.089 | not present | not present | not present | comparison example |
| 5 | 20 | 0.076 | not present | not present | not present | comparison example |
| 6 | 121 | 0.087 | not present | not present | not present | our example |
| 7 | 32 | 0.104 | not present | not present | not present | comparison example |
| 8 | 34 | 0.073 | not present | not present | not present | comparison example |
| 9 | 31 | 0.073 | not present | not present | not present | comparison example |
| 10 | 118 | 0.096 | not present | not present | not present | our example |

Underlined steels falling outside our scope.

*TM: tempered martensite phase, F: ferrite phase, γ: residual austenite phase

**precipitates having grain size of 2 μm or less

All high-strength seamless stainless steel pipes in our examples proved to be seamless stainless steel pipes exhibiting all of: high strength where yield strength is 758 MPa or more; high toughness where an absorbing energy value $vE_{-10}$ at −10° C. is 40 J or more in the Charpy impact test; excellent corrosion resistance (carbon dioxide gas corrosion resistance) in a high temperature corrosive environment at a temperature of 200° C. containing $CO_2$ and Cr; and excellent sulfide stress cracking resistance and excellent sulfide stress corrosion cracking resistance without generating cracking (SSC, SCC) in an environment containing $H_2S$. On the other hand, the seamless stainless steel pipes of the comparison examples which do not fall within our scope deteriorated toughness.

The invention claimed is:

1. A high-strength seamless stainless steel pipe having a composition comprising, by mass %, 0.05% or less C, 1.0% or less Si, 0.1 to 0.5% Mn, 0.05% or less P, 0.005% or less S, more than 16.0% to 18.0% or less Cr, more than 2.0% to 3.0% or less Mo, 0.5 to 3.5% Cu, 3.0% or more and less than 5.0% Ni, 0.01 to 3.0% W, 0.01 to 0.1% Nb, 0.001 to 0.004% Ti, 0.001 to 0.1% Al, less than 0.07% N, 0.01% or less O, and Fe and unavoidable impurities as a balance, wherein the steel pipe has a microstructure comprising a tempered martensite phase forming a main phase, 20 to 40% of a ferrite phase in terms of volume ratio, and 25% or less of a residual austenite phase in terms of volume ratio, an average grain size of the ferrite phase is 40 μm or less, and a sum of amounts of Ti and Nb precipitated as precipitates having a grain size of 2 μm or less is 0.06 mass % or more, whereby the steel pipe has high strength where yield strength YS is 758 MPa or more and high toughness where an absorbing energy value $vE_{-10}$ in a Charpy impact test at a test temperature of −10° C. is 40J or more.

2. The stainless steel pipe according to claim 1, wherein the composition further contains, by mass %, one kind or two or more kinds selected from a group consisting of 0.5% or less V, 0.2% or less Zr, 1.4% or less Co, 0.1% or less Ta, and 0.0050% or less B.

3. The stainless steel pipe according to claim 1, wherein the composition further contains, by mass %, one kind or two kinds selected from a group consisting of 0.0005 to 0.0050% Ca and 0.001 to 0.01% REM.

4. The stainless steel pipe according to claim 2, wherein the composition further contains, by mass %, one kind or two kinds selected from a group consisting of 0.0005 to 0.0050% Ca and 0.001 to 0.01% REM.

5. A method of manufacturing the stainless steel pipe according to claim 1, the method comprising:

a heating step of heating a steel pipe raw material having the composition;

a hot pipe forming step of forming a seamless steel pipe by applying hot pipe forming to the steel pipe raw material heated in the heating step;

a cooling step of cooling the seamless steel pipe obtained by the hot pipe forming step; and a heat treatment step of applying quenching treatment to the seamless steel pipe cooled by the cooling step at a heating temperature of 850 to 1050° C. and applying tempering treatment to the seamless steel pipe subsequently, wherein in the heating step, the steel pipe raw material is heated at a heating temperature T(° C.) of 1210 to 1350° C. and subsequently cooled after heating the steel pipe raw material at the heating temperature T so that an average grain size A (μm) of precipitates of Ti and Nb at the heating temperature T and a sum of amounts B (mass %) of precipitated Ti and Nb satisfy formula (1)

$$A/B^{2/3} \leq 14.0 \quad (1)$$

wherein, A: average grain size (μm) of precipitates of Ti and Nb at heating temperature T B: sum of amounts (mass %) of precipitated Ti and Nb at heating temperature T.

6. A method of manufacturing the stainless steel pipe according to claim 2, the method comprising:

a heating step of heating a steel pipe raw material having the composition;

a hot pipe forming step of forming a seamless steel pipe by applying hot pipe forming to the steel pipe raw material heated in the heating step;

a cooling step of cooling the seamless steel pipe obtained by the hot pipe forming step; and a heat treatment step of applying quenching treatment to the seamless steel pipe cooled by the cooling step at a heating temperature of 850 to 1050° C. and applying tempering treatment to the seamless steel pipe subsequently, wherein in the heating step, the steel pipe raw material is heated at a heating temperature T(° C.) of 1210 to 1350° C. and subsequently cooled after heating the steel pipe raw material at the heating temperature T so that an average grain size A (μm) of precipitates of Ti and Nb at the heating temperature T and a sum of amounts B (mass %) of precipitated Ti and Nb satisfy formula (1)

$$A/B^{2/3} \leq 14.0 \quad (1)$$

wherein, A: average grain size (μm) of precipitates of Ti and Nb at heating temperature T B: sum of amounts (mass %) of precipitated Ti and Nb at heating temperature T.

7. A method of manufacturing the stainless steel pipe according to claim 3, the method comprising:

a heating step of heating a steel pipe raw material having the composition;

a hot pipe forming step of forming a seamless steel pipe by applying hot pipe forming to the steel pipe raw material heated in the heating step;

a cooling step of cooling the seamless steel pipe obtained by the hot pipe forming step; and a heat treatment step of applying quenching treatment to the seamless steel pipe cooled by the cooling step at a heating temperature of 850 to 1050° C. and applying tempering treatment to the seamless steel pipe subsequently, wherein in the heating step, the steel pipe raw material is heated at a heating temperature T(° C.) of 1210 to 1350° C. and subsequently cooled after heating the steel pipe raw material at the heating temperature T so that an average grain size A (μm) of precipitates of Ti and Nb at the heating temperature T and a sum of amounts B (mass %) of precipitated Ti and Nb satisfy formula (1)

$$A/B^{2/3} \leq 14.0 \quad (1)$$

wherein, A: average grain size (μm) of precipitates of Ti and Nb at heating temperature T B: sum of amounts (mass %) of precipitated Ti and Nb at heating temperature T.

8. A method of manufacturing the stainless steel pipe according to claim 4, the method comprising:

a heating step of heating a steel pipe raw material having the composition;

a hot pipe forming step of forming a seamless steel pipe by applying hot pipe forming to the steel pipe raw material heated in the heating step;

a cooling step of cooling the seamless steel pipe obtained by the hot pipe forming step; and a heat treatment step of applying quenching treatment to the seamless steel pipe cooled by the cooling step at a heating temperature of 850 to 1050° C. and applying tempering treatment to the seamless steel pipe subsequently, wherein in the heating step, the steel pipe raw material is heated at a heating temperature T(° C.) of 1210 to 1350° C. and subsequently cooled after heating the steel pipe raw material at the heating temperature T so that an average grain size A (μm) of precipitates of Ti and Nb at the heating temperature T and a sum of amounts B (mass %) of precipitated Ti and Nb satisfy formula (1)

$$A/B^{2/3} \leq 14.0 \quad (1)$$

wherein, A: average grain size (μm) of precipitates of Ti and Nb at heating temperature T B: sum of amounts (mass %) of precipitated Ti and Nb at heating temperature T.

* * * * *